United States Patent [19]

Higuchi et al.

[11] Patent Number: 4,789,314

[45] Date of Patent: Dec. 6, 1988

[54] MULTI-SECTION ROOTS VACUUM PUMP OF REVERSE FLOW COOLING TYPE WITH INTERNAL FLOW DIVISION ARRANGEMENT

[75] Inventors: Tsutomu Higuchi, Yokohama; Shigeharu Kambe, Kawasaki, both of Japan

[73] Assignee: Unozawa-Gumi Iron Works, Ltd., Tokyo, Japan

[21] Appl. No.: 65,409

[22] Filed: Jun. 23, 1987

[30] Foreign Application Priority Data

Dec. 18, 1986 [JP] Japan ..... 61-300150

[51] Int. Cl.[4] ..... F04C 18/18; F04C 23/00; F04C 25/02; F04C 29/04

[52] U.S. Cl. ..... 418/9; 418/15; 418/83; 417/243

[58] Field of Search ..... 418/9, 15, 83; 417/243

[56] References Cited

U.S. PATENT DOCUMENTS 3,535,058 10/1970 Devine ..... 418/9
3,667,874 6/1972 Weatherston et al. ..... 418/9

FOREIGN PATENT DOCUMENTS 59-115489 7/1984 Japan ..... 418/9
61-197793 9/1986 Japan ..... 418/9

*Primary Examiner*—John J. Vrablik
*Attorney, Agent, or Firm*—Merchant, Gould, Smith, Edell, Welter & Schmidt

[57] ABSTRACT

A multi-section Roots vacuum pump of the reverse flow cooling type with internal flow division arrangement includes a sequence of pump sections, casings for the pump sections including housings for accommodating pairs of rotor therein, inlet passages and outlet passages connected to the casing for pump sections, upper peripheral gas passages connected to the inlet passage formed around an upper portion of the housing, lower peripheral gas passages connected to a supply inlet of reverse flow cooling gas formed around a lower portion of the housing, partition walls between the upper and lower peripheral gas passages, and inter-section walls for separating adjacent pump sections. Communicating passages are formed through the inter-section walls for communicating the lower peripheral gas passages of a pump section with the upper peripheral gas passages of the following pump section, connection pipes are provided between an outlet passage of the casing of a pump section and an inlet passage of the casing of the following pump section, and coolers are provided in the connection pipes.

9 Claims, 7 Drawing Sheets

MULTI-SECTION ROOTS VACUUM PUMP OF REVERSE FLOW COOLING TYPE WITH INTERNAL FLOW DIVISION ARRANGEMENT

BACKGROUND OF THE INVENTION

1. Field of the Invention

The present invention relates to a multi-section Roots vacuum pump of the reverse flow cooling type with an internal flow division arrangement. The present invention can be applied to the reverse flow cooling type multi-section Roots vacuum pump which is operated at a high compression ratio in the range between atmospheric pressure and $10^{-3}$ Torr and at a relatively high temperature.

2. Description of the Related Art

Generally in a Roots type vacuum pump in which rotor pairs rotating in a housing to draw in and discharge gas have a minute clearance from the housing which accommodates the rotor pairs therein, it is important that the clearance between the rotor and the housing be as small as possible in order to realize a pump having a high performance. So far, in a multi-section Roots vacuum pump driven at a high compression ratio, wherein the temperature will rise relatively high due to the compression heat during the operation, the selected clearance is usually based on the expected temperature of the rotor pairs and the housing in the operating state. However, since the housing is in direct contact with the external atmosphere, the temperature of the housing is affected by the change of the temperature of the atmosphere. Therefore, the selected clearance should be such that variation of the thermal expansion of the housing due to a change of the temperature of the atmosphere is taken into consideration. This situation is an obstacle to the realization of the as small as possible clearance.

In the prior art, in order to minimize the effect of the ambient temperature and to cool the pump device, a jacket for cooling water is provided at the peripheral portion of the housing, and a thermo-sensor and other devices also provided to control the flow of cooling water running through the jacket and the temperature thereof, to maintain as constant a temperature of the housing as possible. However, this method is not advantageous because the thermo-sensor and/or other devices for controlling the flow and temperature of cooling water are required.

In a prior art Roots type vacuum pump, due to the radiation of heat to the open air, the temperature of the housing becomes lower than that of the rotor pairs inside the housing during the operation of the pump, thus the clearance between the housing and the rotor pairs is reduced because the amount of thermal expansion of the housing becomes smaller than the amount of thermal expansion of the rotor pairs, resulting in contact between the housing and the rotor pairs. To prevent such contact, a jacket is provided at a peripheral portion of the housing of the pump, with an open passage provided to communicate one end of the jacket to the outlet passage, wherein the discharged gas heated by the compression will be circulated within the jacket by the flow turbulence caused by the rotation of the rotor pairs, to equalize the temperature of the housing and that of the rotor pairs. However, because the open passage of the jacket is provided at only one place, and an insufficient amount of discharged gas flows through the jacket, a satisfactory result cannot be attained.

Furthermore, an outer piping is led from one portion of the jacket to the outlet pipe of the pump, to ease the flow of the discharged gas to the jacket. However, in this example, the outer piping is specifically required and, moreover, the pressure difference between the upstream side and downstream side of the outer piping is too small to secure a sufficient flow of gas. Therefore, this method is not advantageous.

Further, Japanese Unexamined Patent Publication No. 59-115489 has disclosed, for a reverse flow cooling type multi-section Roots vacuum pump, a pump that comprises a connection pipe provided to connect the outlet passage of a specific pump section with the inlet passage of the following pump section, a cooler incorporated to the connection pipe, and a reverse flow pipe branched off from the connection pipe at the downstream side of the cooler and arranged to lead the reverse flow cooling gas to the preceding pump section.

In a reverse flow cooling type multi-section Roots vacuum pump, reverse flow pipes are provided to lead reverse flow cooling gas from the connection pipes between adjacent pump sections in a bifurcated manner, as an outside piping arrangement of the pump. However, such an outside piping arrangement has a comparatively complicated structure and, therefore, is relatively unprofitable from the viewpoints of miniaturization of the pump and manufacturing cost of the piping arrangement. Moreover, the reverse flow piping, manufactured from comparatively thin piping material such as flexible piping, can be a source of noise. Further, since the housing comes into direct contact with the open air, and the temperature of the housing will be affected by changes of ambient temperature during the operation of the pump, the predetermined clearance amount between the rotor pairs and the housing must additionally include the amount of change by thermal expansion caused by the ambient thermal change, causing a problem in the realization of a practical smallest clearance. Therefore, preferably the gas leakage from such a clearance is minimized as much as possible, to realize a pump having a high performance.

SUMMARY OF THE INVENTION

An object of the present invention is to improve the performance of a reverse flow cooling type multi-section Roots vacuum pump by practically minimizing the amount of gas leakage through the clearance between the periphery and both ends of the rotor pairs and the housing. To this end, considering the problems in the conventional types of the Roots vacuum pumps, a preferred embodiment of the present invention may maintain a constant temperature of the housing during the operation of the pump, without providing additional devices, regardless of changes in the ambient temperature, so that the change in the amount of thermal expansion of the housing caused by ambient thermal change is kept to a minimum, and thus the clearance between the periphery and both side ends of the rotor pairs and the housing is maintained at a constant value with only a minimal change while the pump is running, resulting in a practically minimal amount of gas leakage through the clearance.

Another object of the present invention is to realize a miniaturization of the dimensions of the pump and to reduce the cost for manufacturing an outside piping arrangement, as well as a reduction of the noise level of the pump. To this end, in an embodiment of the invention, the outside piping arrangement is simplified by eliminating a reverse flow pipe for reverse flow cooling gas which has, up to now, been provided as an outside piping and is an undesirable source of noise.

In accordance with the present invention, there is provided a multi-section Roots vacuum pump of the reverse flow cooling type with an internal division arrangement, comprising: a sequence of pump sections; two shafts common to the sequence of pump sections for transmitting driving power; a sequence of rotor pairs coupled to the shafts; casings for the pump section including housings for accommodating rotor pairs therein; inlet passages and outlet passages connected to the casing; upper peripheral gas passages formed around an upper portion of the housing; lower peripheral gas passages connected to a supply inlet of reverse flow cooling gas formed around a lower portion of the housing; partition walls between the upper and lower peripheral gas passages; and inter-section walls for separating adjacent pump sections. Communicating passages are formed through the inter-section walls for communicating the lower peripheral gas passages of a pump section with the upper peripheral gas passages of the following pump section, connection pipes are provided between an outlet passage of the casing of a pump section and an inlet passage of the casing of the following pump section, and coolers are provided in the connection pipe.

The operation of the vacuum pump according to the present invention will now be explained. Gas drawn in through the inlet passage of each pump section is divided at the inlet passage into two gas flows: one being a flow of gas to be compressed in the present pump section, the other being a flow of gas for reverse flow cooling to be sent back to the preceding pump section. The gas to be compressed in the present pump section is compressed by the reverse flow cooling gas which comes from the following pump section through the lower peripheral gas passage into the housing of the pump section via the supply inlet of reverse flow cooling gas, and is discharged from the outlet passage. The discharged gas flows into the cooler via the connection pipe, is cooled to an appropriate and stabilized temperature, is sent through the connection pipe, and is drawn in through the inlet passage of the following pump section.

On the other hand, since a sufficient flow amount of the reverse flow cooling gas to be reversely flowed to the preceding pump section is ensured by the pressure difference between the intake and discharge pressures of the preceding pump section, to maintain the temperature of the housing which accommodates the rotor pairs therein at an appropriate and stabilized level, the gas can be transmitted through the upper peripheral gas passage provided at the peripheral portion of the housing of the specific pump section, via the communicating passage, into the housing from the lower peripheral gas passage of the preceding pump section, where the gas drawn in from the inlet passage of the preceding pump section is compressed while keeping the rise of temperature very low, and is discharged from the outlet passage. The operations described above are performed successively at each pump section.

DESCRIPTION OF THE PREFERRED EMBODIMENTS

Before describing the preferred embodiments of the present invention, the prior art reverse flow cooling type Roots vacuum pump is described with reference to FIGS. 1, 2, and 3, for a better understanding of the background of the present invention.

Figure 1:
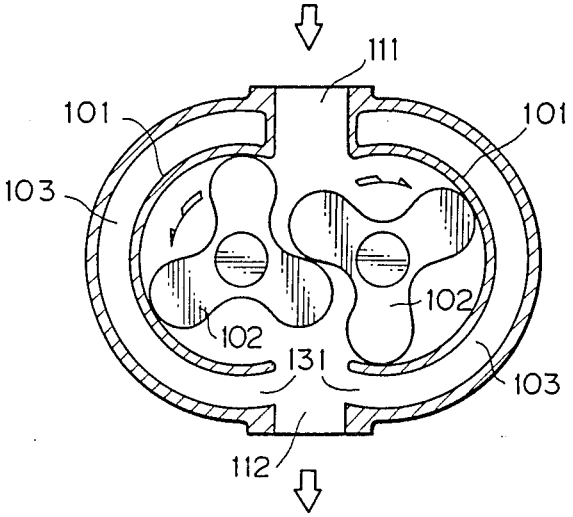
Fig. 1 PRIOR ART
FIGS. 1 and 2 show prior art Roots vacuum pumps.
Figure 2:
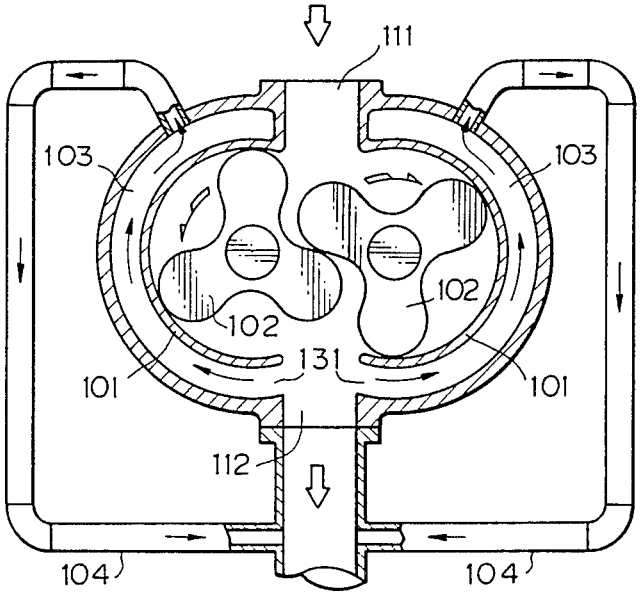
Fig. 2 PRIOR ART

In the Roots type vacuum pump shown in FIGS. 1 and 2, due to the radiation of heat to the open air, the temperature of the housing becomes lower than that of the rotor pairs inside the housing during the operation of the pump and thus the clearance between the housing and the rotor pairs is reduced because the amount of thermal expansion of the housing becomes smaller than the amount of thermal expansion of the rotor pairs, resulting in contact between the housing and the rotor pairs. To prevent such contact, a jacket 103 is provided at a peripheral portion of the housing 101 of the pump, with an open passage 131 provided to communicate one end of the jacket 103 to the outlet passage 112, wherein the discharged gas heated by compression is circulated within the jacket 103 by the flow turbulence caused by the rotation of the rotor pairs, to equalize the temperature of the housing and that of the rotor pairs. However, because the open passage of the jacket is provided at only one place, and an insufficient amount of discharged gas flows through the jacket, a satisfactory result has not been obtained.

As illustrated in FIG. 2, an outer piping 104 is provided from one portion of the jacket to the outlet pipe of the pump, to ease the flow-in of the discharged gas to the jacket. However, in this example, the outer piping is specifically required and, moreover, the pressure difference between the upstream side and downstream side of the outer piping is too small to ensure a sufficient flow of gas, and therefore, this method is relatively unprofitable.

Figure 3:
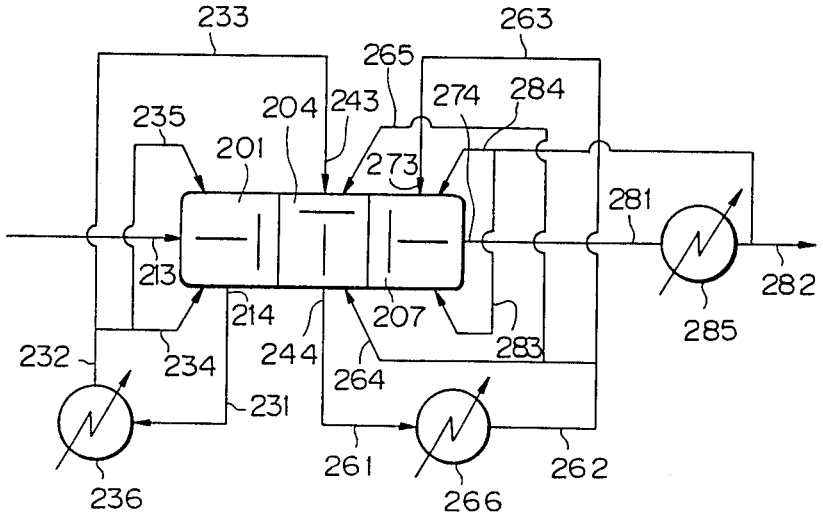
Fig. 3 PRIOR ART
FIG. 3 shows a prior art three-section Roots vacuum pump as a multi-section reverse flow cooling type Roots vacuum pump.

As shown in FIG. 3, commonly, in a reverse flow cooling type multi-section Roots vacuum pump as disclosed in Japanese Unexamined Patent Publication (Kokai) No. 59-115489, a connection pipe is provided to connect the outlet passage of a specific pump section with the inlet passage of the following pump section, a cooler is incorporated to the connection pipe, and a reverse flow pipe is branched off from the connection pipe at the downstream side of the cooler and arranged to lead the reverse flow cooling gas to the preceding pump section.

In the prior art 3-section Roots vacuum pump shown in FIG. 3, an outlet passage 214 of the first pump section 201 is connected to an inlet passage 243 of the second pump section 204 by a series of connection pipes 231, 232, and 233, a cooler 236 is incorporated between connection pipes 231 and 232, and a series of reverse flow pipes 234 and 235 is provided and branched off from the connection pipe 232 to lead reverse flow cooling gas to the housing of the first pump section 201. In the same manner, an outlet passage 244 of the second pump section 204 is connected to an inlet passage 273 of the third pump section 207 by a series of connection pipes 261, 262, and 263, a cooler 266 is incorporated between the connection pipes 261 and 262, and a series of the reverse flow pipes 264 and 265 is provided and branched off from the connection pipe 262 to lead reverse flow cooling gas to the housing of the second pump section 204. Likewise, a series of outlet pipes 281 and 282 is connected to the outlet passage 274 of the third pump section 207, with a cooler 285 incorporated between the outlet pipes 281 and 282, and a series of reverse flow pipes 283 and 284 is provided in a bifurcated manner from the outlet pipe 282 to the housing of the third pump section 207.

Figure 4:
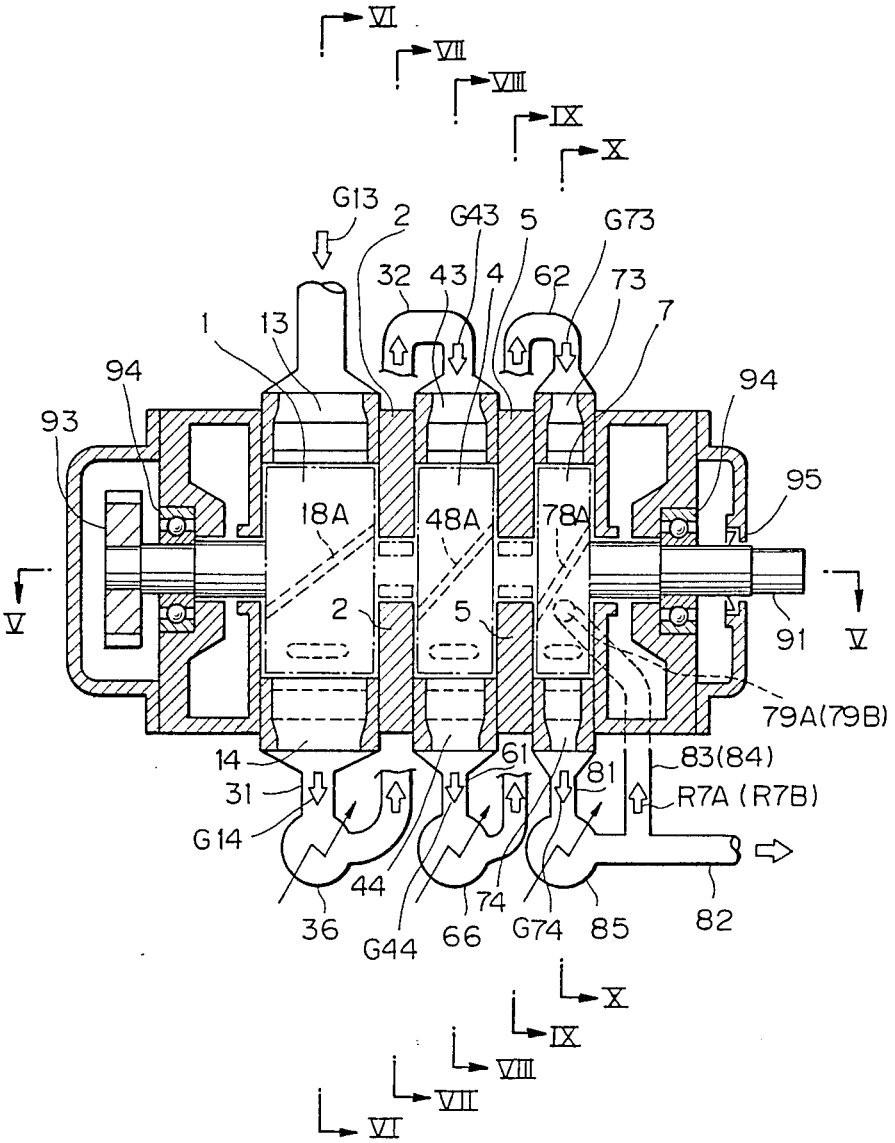
FIG. 4 shows a reverse flow cooling type three-section Roots vacuum pump according to an embodiment of the present invention.
Figure 5:
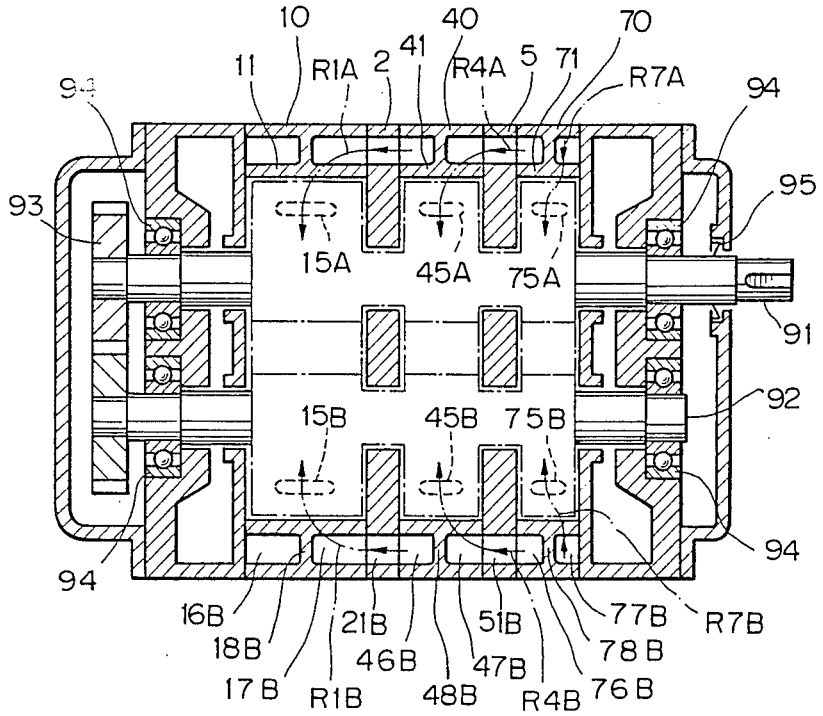
FIG. 5 is a cross sectional view of a main body of the pump taken along the plane represented by the line V—V in FIG. 4.

A multi-section Roots vacuum pump of the reverse flow cooling type with an internal flow division arrangement is shown in FIG. 4. The structure shown in FIG. 4 has a first pump section 1, a second pump section 4, and a third pump section 7. FIG. 5 shows a cross section of the pump body taken along the plane represented by the line V—V in FIG. 4. FIGS. 6 to 10 are cross sectional views taken along the planes represented by the lines VI—VI, VII—VII, VIII—VIII, IX—IX and X—X in FIG. 4.

Referring to FIGS. 4 and 5, the first pump section 1 and the second pump section 4 are separated by an inter-section wall 2, and the second pump section 4 and the third pump section 7 are separated by an intersection wall 5. As shown in FIG. 5, the first shaft 91 and the second shaft 92, supported by a bearing mechanism 94, pass through a specific pump section and are made to rotate in opposite directions by a timing gear mechanism 93. The first shaft 91 passes through a shaft sealing mechanism 95 and can be driven by an electrical motor. In FIG. 4, an outlet passage 14 of the first pump section 1 is connected with an inlet passage 43 of the second pump section 4 by connection pipes 31 and 32, and a cooler 36 is provided between these connection pipes 31 and 32. Likewise, an outlet passage 44 of the second pump section 4 is connected with an inlet passage 73 of the third pump section 7 by connection pipes 61 and 62, and a cooler 66 is provided between these connection pipes 61 and 62. Further, an outlet passage 74 of the third pump section 7 is connected with discharge pipes 81 and 82, a cooler 85 is provided between the discharge pipes 81 and 82, and reverse flow pipings 83 and 84 are provided in such a manner that the reverse flow pipings 83 and 84 branch off from the discharge pipe 82 to be connected with the housing 71 of the third pump section 7.

Figure 6:
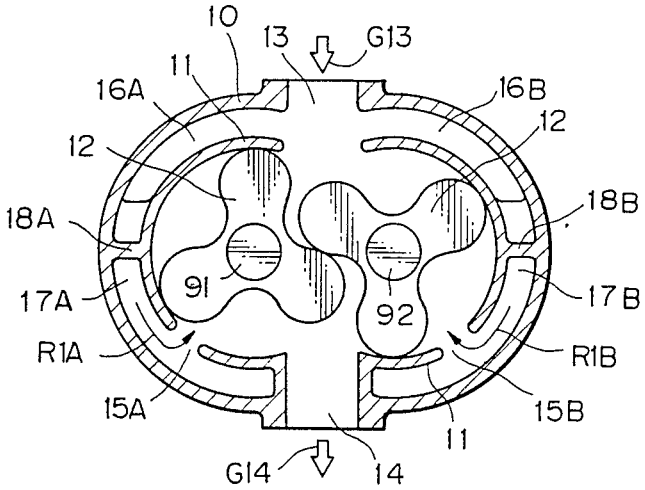
FIGS. 6 to 10 are cross-sectional views taken along the planes represented by VI—VI, VII—VII, VIII—VIII, IX—IX, and X—X in FIG. 4.

Referring to FIG. 6, the first pump section 1 includes a casing 10, a housing 11, a pair of rotors 12, 12, an inlet passage 13, an outlet passage 14, upper peripheral gas passages 16A, 16B, and lower peripheral gas passages 17A, 17B. Supply inlets 15A, 15B for reverse flow cooling gas are provided in the housing 11. Partition walls 18A, 18B are provided for separating the upper and lower peripheral gas passages 16A, 16B, 17A, 17B. The rotors 12, 12 are fixed to shafts 91 and 92.

Figure 8:
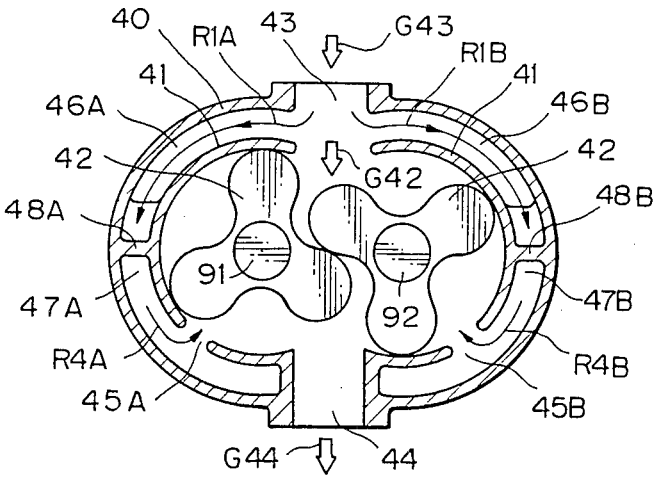

In FIG. 8, the second pump section 4 includes a casing 40, a housing 41, a pair of rotors 42, 42, an inlet passage 43, an outlet passage 44, upper peripheral gas passages 46A, 46B, and lower peripheral gas passages 47A, 47B. Partition walls 48A, 48B are provided for separating the upper and lower peripheral gas passages 46A, 46B, 47A, 47B. The rotors 42, 42 are fixed to shafts 91 and 92.

Figure 10:
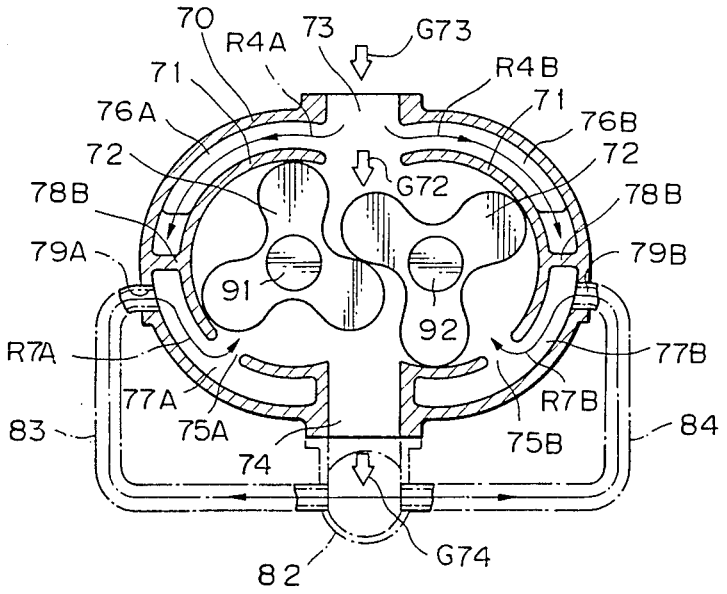

Referring to FIG. 10, the third pump section 7 includes a casing 70, a housing 71, a pair of rotors 72, 72, an inlet passage 73, an outlet passage 74, upper peripheral gas passages 76A, 76B, and lower peripheral gas passages 77A, 77B. Supply inlets 75A, 75B for reverse flow cooling gas are provided in the housing 71. Partition walls 78A, 78B are provided for separating the upper and lower gas passages 76A, 76B, 77A, 77B. The lower peripheral gas passages 77A, 77B has supply inlets 79A, 79B for reverse flow cooling gas on the outer wall thereof. The rotors 72, 72 are fixed to the shafts 91 and 92.

Figure 7:
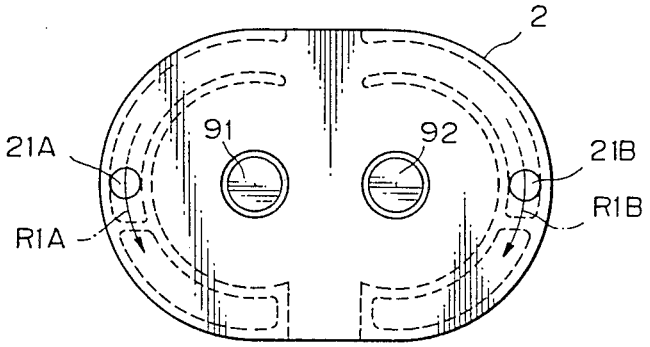

Referring to FIG. 7, an inter-section wall 2 between the first and the second pump sections is provided with communicating passages 21A, 21B formed through the inter-section wall for communicating the lower peripheral gas passages 17A, 17B of the housing 11 of the first pump section 1 with the upper peripheral gas passages 46A, 46B of the housing 41 of the second pump section 4.

Figure 9:
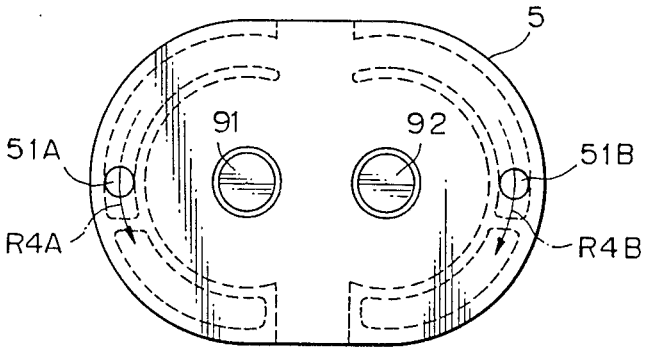

In FIG. 9, an inter-section wall 5 between the second and the third pump sections is provided with communication passages 51A, 51B formed through the inter-section wall for communicating the lower peripheral gas passages 47A, 47B of the housing 41 of the second pump section 4 with the upper peripheral gas passages 76A, 76B of the housing 71 of the third pump section 7.

Referring to FIGS. 4 through 10, the operation of the pump will be explained. In the first pump section 1, gas is drawn in as intake gas G13 from the inlet passage 13, as shown in FIGS. 1 and 3, then subsequently transmitted by the rotation of the rotors 12, 12. At that time, the gas is compressed by a reverse flow cooling gas R1A, R1B, which enters the housing 11 from the lower peripheral gas passages 17A, 17B via the supply inlets 15A, 15B, and is discharged from the outlet passage 14 as discharge gas G14. The discharge gas G14 flows through the connection pipe 31 into the cooler 36, is cooled to an appropriate and stabilized temperature, and the cooled gas flows through the connection pipe 32 to be drawn in through the inlet passage 43 of the second pump section 4 as intake gas G43.

In the second pump section 4, intake gas G43, as shown in FIGS. 1 and 3, is divided into two parts at the inlet passage: gas G42 to be compressed at the second pump section 4, and reverse flow cooling gas R1A, R1B transmitted to the first pump section 1. The gas G42 to be compressed at the second pump section 4 is transmitted by the rotation of the rotors 42, 42. At that time, the gas G42 is compressed by the reverse flow cooling gas R4A, R4B, which is sent from the third pump section 7 through the lower peripheral gas passage 47A, 47B into the housing 41 via the supply inlet 45A, 45B for reverse flow cooling gas, and discharged from the outlet passage 44 as discharge gas G44. The discharge gas G44 flows through the connection pipe 61 into the cooler 66 and is cooled to an appropriate and stabilized temperature. The cooled gas then flows through the connection pipe 62 to be drawn in through the inlet passage 73 of the third pump section 7 as intake gas G73.

On the other hand, the reverse flow cooling gas R1A, R1B, for maintaining the temperature of the housing which accommodates the rotors 42, 42 therein at an appropriate and stabilized level, flows through the upper peripheral gas passage 46A, 46B of the second pump section 4 to the lower peripheral gas passage 17A, 17B of the first pump section 1 shown in FIG. 6, via the communicating passage 21A, 21B on the inter-section wall 2 between the first and second pump sections shown in FIG. 7, and then flows into the housing 11 of the first pump section 1 through the inlet passage 15A, 15B to compress the intake gas G13, thus preventing a rise of temperature of the intake gas.

In the third pump section 7, as shown in FIGS. 4 and 10, the intake gas G13 is divided into two parts at the inlet passage 73: gas G72 to be compressed at the third pump section 7, and reverse ±low cooling gas R4A, R4B sent back to the second pump section 4. The gas G72 to be compressed at the third pump section 7 is transmitted by the rotation of the rotors 72, 72. At that time, the gas is compressed by the reverse flow cooling gas R7A, R7B, which flows through the lower peripheral gas passage 77A, 77B into the housing 71 via the supply inlet 75A, 75B for reverse flow cooling gas, and then discharged from the outlet passage 74 as discharge gas G74. The discharge gas G74 flows through the connection pipe 81 into the cooler 85, and is cooled to an appropriate and stabilized temperature. A portion of this gas G74 may be discharged to the atmosphere through a delivery pipe 82, and another portion flowed to the reverse flow pipe 83, 84 which branches off from the delivery pipe 82. The R7A, R7B that has flowed into the reverse flow pipe 83, 84, flows to the lower peripheral gas passage 77A, 77B via an intake passage 79A, 79B, while maintaining the temperature of the housing at an appropriate and stabilized level, and flows into the housing 71 of the third pump section 7 via the supply inlet 75A, 75B for reverse flow cooling gas. The flowing gas may compress the gas G72, which might be compressed in the third pump section 7 by the reverse flow cooling gas, keeping the rise of temperature low, and may be discharged as discharge gas G74.

Meanwhile, the reverse flow cooling gas R4A, R4B, while maintaining the temperature of the housing at an appropriate and stabilized level, flows through the upper peripheral gas passage 76A, 76B of the third pump section 7, to the lower peripheral gas passage 47A, 47B of the second pump section 4 shown in FIG. 8 via the communicating passage 51A, 51B on the inter-section wall 5 between the second and the third pump sections shown in FIG. 9, and then flows through the supply inlet 45A, 45B for reverse flow cooling gas to the housing 41 of the second pump section 4, will compress the gas G42 which might be compressed at the second pump section, keeping the rise of temperature low, and may be delivered as discharge gas G44.

In the case of a reverse flow cooling type multi-section Roots vacuum pump according to the present invention, any gas drawn-in from the inlet passage of a specific pump section will be separated at the inlet passage into the gas to be compressed at the specific pump section and the reverse flow cooling gas which may be transmitted to a specific preceding pump section.

Among these, the gas to be compressed at each pump section will be compressed by the reverse flow cooling gas which flows from the following pump section through the lower peripheral gas passage, via the supply inlet for reverse flow cooling gas into the housing of the corresponding pump section, and may be discharged from the outlet passage. The discharged gas flows through the connection pipe to the cooler, wherein the discharged gas is cooled to an appropriate and stabilized temperature, flows through the connection pipe and may be drawn in by the following pump section via the inlet passage. On the other hand, among the separated gas portions, reverse flow cooling gas which might be transmitted to the preceding pump section, a sufficient volume of which is ensured due to the pressure difference between intake pressure and discharge pressure, keeping the temperature of the housing which accommodates the rotor pair to an appropriate and stabilized level, flows through the peripheral gas passages provided at peripheral portion of each pump section into the housing from the peripheral gas passage of the preceding pump section via the communicating passage on the intersection wall which divides the pump section from the preceding pump section, compresses the gas drawn in from the inlet passage of the preceding pump section, keeping the rise of temperature low, and is discharged from the outlet passage. The actions described above are performed successively at each pump section.

In a reverse flow cooling type multi-section Roots vacuum pump shown in FIG. 4, normally driven at a high compression ratio in which the temperature rises comparatively high during operation, a sufficient gas flow is ensured due to the pressure difference between the intake pressure and discharge pressure at each pump section. By using the arrangement in which a reverse flow cooling gas, which is cooled by the cooler to an appropriate and stabilized temperature, flows through a gas passage provided at peripheral portion of each pump section into the housing via communicating passage on the inter-section wall, it is possible to maintain a stable temperature of the housing during the operation of the pump device, regardless of the changes of ambient temperature. Therefore, the variation of the thermal expansion of the housing due to the change in ambient temperature is minimized so that the variation of the clearance between the periphery and both sides of the rotor pair and the housing during operation can be minimized. As a result, the clearance can be selected to be much smaller, without the occurrence of an undesirable contact between the rotor pair and the housing, and the gas leakage through the clearance between the rotor pair and the housing can be reduced so that the performance of the reverse flow cooling type multi-section Roots vacuum pump is improved.

In addition, in the vacuum pump shown in FIG. 4, since the vacuum pump does not require a reverse flow gas piping arrangement normally provided around the pump device as an outside piping arrangement, a reduction of the size of the vacuum pump and of the manufacturing cost is possible due to the elimination of the reverse flow gas piping. Since the housing having peripheral gas passages can be manufactured by the iron-casting process, the amount of noise generated from the vacuum pump is reduced to reduce the noise level of the vacuum pump, in comparison with the case where the reverse flow gas piping is normally made of comparatively thin material such as flexible piping.

I claim:

1. A multi-section Roots vacuum pump of the reverse flow cooling type with internal flow division arrangement, comprising:

a sequence of pump sections;

two shafts common to said sequence of pump sections for transmitting driving power;

said pump sections each having a rotor pair coupled to said shafts;

castings for said pump sections including housings for accommodating said rotor pairs therein;

inlet passages and outlet passages of said casings for supplying gas into said casings and discharging gas from said castings;

upper peripheral gas passages formed around upper portions of said housings and connected to said inlet passages for sending gas to the adjacent pump sections;

lower peripheral gas passages formed around lower portions of said housing and connected to supply inlets of reverse flow cooling gas for supplying reverse flow cooling gas into said housings;

partition walls between said upper and lower peripheral gas passages; and inter-section walls for separating adjacent pump sections;

communicating passages being formed through said inter-section walls for communicating said lower peripheral gas passages of pump sections with said upper peripheral gas passages of the following pump sections;

connection pipes being provided between outlet passages of said casing of pump sections and inlet passages of said casing of the following pump sections; and coolers being provided in said connection pipes.

2. A pump according to claim 1, wherein in a first pump section (1) there are provided a casing (10), a housing (11), a pair of rotors (12, 12), an inlet passage (13), an outlet passage (14), upper peripheral gas passages (16A, 16B), lower peripheral gas passages (17A, 17B), partition walls (18A, 18B) between said upper and lower peripheral gas passages, and supply inlets (15A, 15B) through said housing (11) for reverse flow cooling gas.

3. A pump according to claim 1, wherein in a second pump section (4) there are provided a casing (40), a housing (41), a pair of rotors (42, 42), an inlet passage (43), an outlet passage (44), upper peripheral gas passages (46A, 46B), lower peripheral gas passages (47A, 47B), partition walls (48A, 48B) between said upper and lower peripheral gas passages, and supply inlets (45A, 45B) through said housing (41) for reverse flow cooling gas.

4. A pump according to claim 1, wherein in a third pump section (7) there are provided a casing (70), a housing (71), a pair of rotors (72, 72), an inlet passage (73), an outlet passage (74), a housing (71), upper peripheral gas passages (76A, 76B), lower peripheral gas passages (77A, 77B), partition walls (78A, 78B) between said upper and lower peripheral gas passages, and supply inlets (75A, 75B) through said housing (71) for reverse flow cooling gas.

5. A pump according to claim 1, wherein in an inter-section wall (2) between a first pump section (1) and a second pump section (4) there are provided communicating passages (21A, 21B) for communicating lower peripheral gas passages (17A, 17B) of a housing (11) of the first pump section (1) with upper peripheral gas passages (46A, 46B) of the housing (41) of the second pump section (4).

6. A pump according to claim 1, wherein in an inter-section wall (5) between a second pump section (4) and a third pump section (7) there are provided communicating passages (51A, 51B) for communicating lower peripheral gas passages (47A, 47B) of a housing (41) of the second pump section (4) with upper peripheral gas passages (76A, 76B) of the housing (71) of the third pump section (7).

7. A pump according to claim 1, wherein an outlet passage (14) of a first pump section (1) is connected with an inlet passage (43) of a second pump section (4) by connection pipes (31, 32), and a cooler (36) is provided between said connection pipes (31, 32).

8. A pump according to claim 1, wherein an outlet passage (44) of a second pump section (4) is connected with an inlet passage (73) of a third pump section (7) by connection pipes (61, 62), and a cooler (66) is provided between said connection pipes (61, 62).

9. A pump according to claim 1, wherein an outlet passage (74) of a third pump section (7) is connected with discharge pipes (81, 82), a cooler (85) is provided between said discharge pipes (81, 82), and reverse flow pipings (83, 84) are connected between a housing (71) of the third pump section (7) and said discharge pipe (82).

* * * * *

UNITED STATES PATENT AND TRADEMARK OFFICE

CERTIFICATE OF CORRECTION

PATENT NO. : 4,789,314

DATED : December 6, 1988

INVENTOR(S) : Higuchi et al

It is certified that error appears in the above-identified patent and that said Letters Patent is hereby corrected as shown below:

Column 5, lines 31-32, delete "intersection" and insert --inter-section--.

Column 7, line 11, delete "±low" and insert --flow--.

Column 8, line 67, delete "castings" and insert --casings--.

Column 9, line 3, delete "casting" and insert --casings--.

Column 9, line 25, delete "casing" and insert --casings--.

Signed and Sealed this

Thirtieth Day of May, 1989

*Attest:*

*Attesting Officer*

DONALD J. QUIGG

*Commissioner of Patents and Trademarks*